United States Patent [19]

Petersson

[11] 4,141,140

[45] Feb. 27, 1979

[54] APPARATUS FOR FEEDING AND PROCESSING BUTTONS

[75] Inventor: Bengt O. Petersson, Kungsbacka, Sweden

[73] Assignee: Bengt Petersson New Products Investment AB, Goteborg, Sweden

[21] Appl. No.: 778,607

[22] Filed: Mar. 17, 1977

[30] Foreign Application Priority Data

Sep. 13, 1976 [SE] Sweden ..... 7610095
Sep. 16, 1976 [SE] Sweden ..... 7610244

[51] Int. Cl.[2] ..... B23P 21/00

[52] U.S. Cl. ..... 29/787; 29/432; 29/798

[58] Field of Search ..... 29/787, 789, 798, 809, 29/432

[56] References Cited

U.S. PATENT DOCUMENTS

| | | | |
|---|---|---|---|
| 2,133,916 | 10/1938 | Churchill | 29/432 X |
| 3,012,344 | 12/1961 | Schott | 29/787 X |
| 3,199,182 | 8/1965 | Harris et al. | 29/789 X |
| 3,992,765 | 11/1976 | Silverbush | 29/787 X |
| 3,995,359 | 12/1976 | Randolph | 29/809 |
| 4,059,889 | 11/1977 | Randolph et al. | 29/789 X |

*Primary Examiner*—Victor A. Dipalma

[57] ABSTRACT

The present invention relates to an apparatus for the feeding of buttons or similar objects to a processing station e.g., a fastening station. The apparatus comprises a rail arranged to receive a row of the buttons and debouch them at a processing station in which holding means are provided to hold the objects and alternatively release them. At the delivery end of the rail two holding elements are provided to allow the feeding of one of the buttons from the rail, catch the fed button and hold it in the processing station and release the button after the processing. According to the invention the holding elements each has the form of a section, rotatable into three positions around an axis. In the first position both the sections are placed opposite to the open delivery end of the rail allowing the feeding of one button from the rail. In the second position they are placed opposite to each other holding the button between the sections. In the third position the sections are placed adjacent to the end of the rail, releasing the button to be removed from the sections.

2 Claims, 18 Drawing Figures

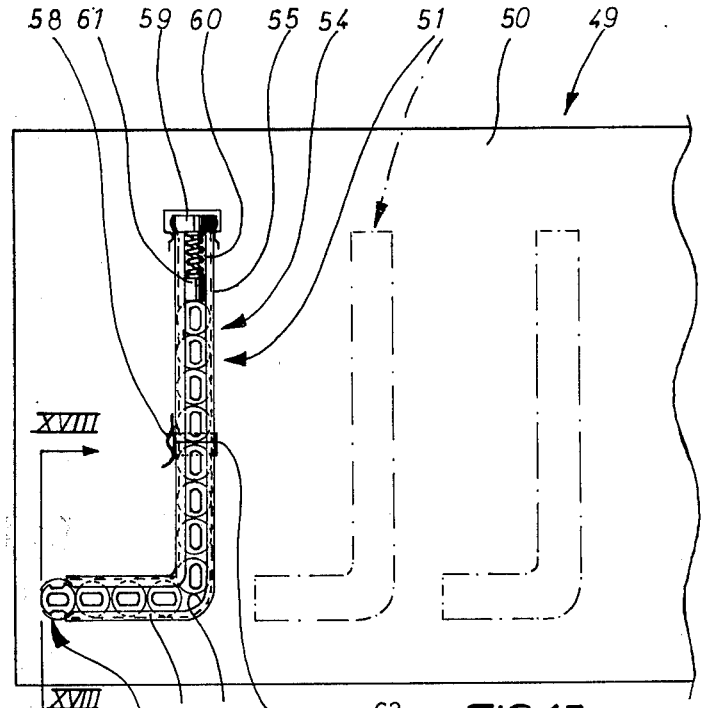
FIG.15
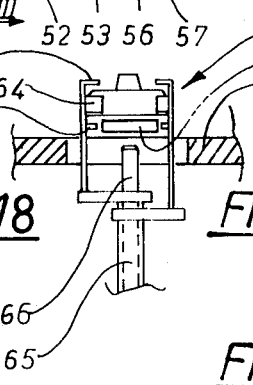
FIG.18
FIG.16
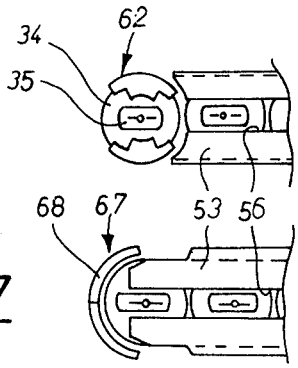
FIG.17

APPARATUS FOR FEEDING AND PROCESSING BUTTONS

When fastening objects such as buttons, hooks, eyes in connection with cloth, plastic web or similar, a sewing procedure is often used. Also when using automatic sewing machines the sewing of, for example, buttons is, however, a time consuming and not very rational job at the same time as the strength of the bond leaves a lot to be desired in other respects. To some extent also other fastening methods are used. By way of example spring fasteners are usually fastened by two parts being coupled together round the edges of a hole in the textile material, so that the spring fastener is attached to the same by pinching action. Buttons intended to be used in connection with buttonholes and permitting a seamless mode of attachment are also known. In such connection a button with two heads is used, one head on each side of the textile material and the two heads are coupled together by means of a stalk extending through a hole in the material. However, such buttons suffer from the drawback that they lack in adaptability and they can therefore only be used in heavier articles of dress, like workingclothes. As there are no parts gripping over the threads in the textile material, the risk is great that the hole, through which the stalk extends, will get wider, so that the button is lost, which is another reason for not using such buttons in other types of cloth than heavy ones.

When the buttons have to be processed in a machine in an automatic fashion, it is necessary to use a feeding apparatus. This apparatus will store a number of buttons and feed them one by one to a processing station where the buttons are held for processing and then released after processing to be removed from the apparatus. As an example of such processing is the fastening of the buttons on cloth, plastic web or similar materials. In this fastening operation the buttons have to be presented one by one to a fastening station in which the button is placed in the correct position to be attached to the cloth or the like. In the fastening station the button is held during the fastening operation. After the button is attached to the cloth the button has to be released and withdrawn from the processing station and the feeding apparatus together with the cloth to which the button is attached. It is the object of the invention to provide an apparatus, by means of which the button or similar objects can be fed in a rational manner to a processing station.

In the accompanying drawings several variants of embodiments of the invention are illustrated.

Figure 1:
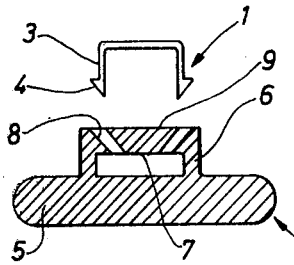
FIG. 1 shows two details, which form the button to the be fed, one detail being illustrated in a view while the other one is shown in a sectional view.
Figure 3:
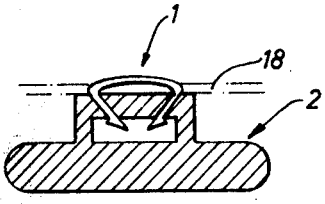

FIG. 3 corresponds to FIG. 1 but with the difference that both the details are coupled together.

Figure 4:
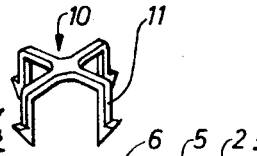

FIG. 4 shows one of the details of a second variant in perspective view.

Figure 5:
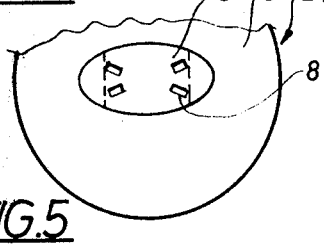

FIG. 5 shows one of the details in a front view of a variant, which is adapted to the variant of the first detail of FIG. 4.

Figure 6:
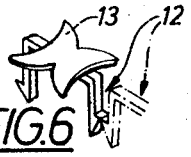

FIG. 6 shows a third variant of the first detail in perspective view, and

Figure 7:
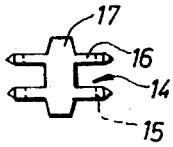

FIG. 7 shows the first detail in a fourth variant in a front view.

Figure 8:
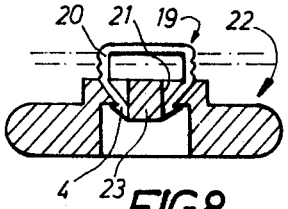

FIG. 8 shows still another variant in a crossection corresponding to FIG. 3.

Figure 9:
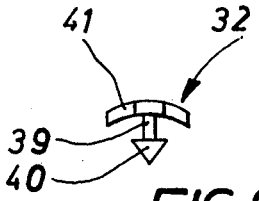

FIG. 9 shows a side elevational view of a detail of a button to be fed in still another variant.

Figure 10:
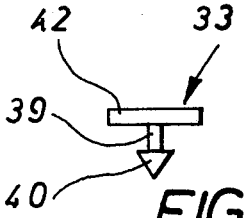

FIG. 10 shows a corresponding side elevational view of the second variant.

Figure 11:
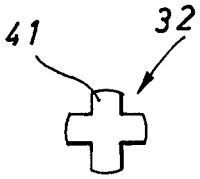

FIG. 11 shows a front view of the detail of FIG. 9 and

Figure 2:
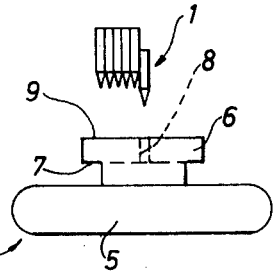
FIG. 2 shows both details in view seen at right angle to the direction of the view in FIG. 1.
Figure 12:
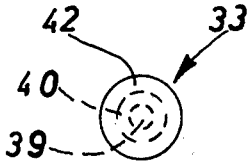

FIG. 12 shows a front view of the detail of FIG. 2.

Figure 13:
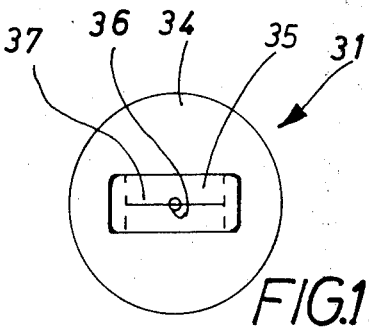

FIG. 13 shows another detail of a button to be fed, which detail is common for the two embodiments.

Figure 14:
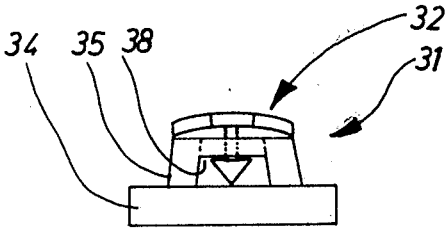

FIG. 14 shows one of the details of each one of the FIGS. 9 and 11 coupled together to a compound button.

FIG. 15 shows a top view of the apparatus according to the invention in a first embodiment.

FIG. 16 shows a detail of FIG. 15 on an enlarged scale.

FIG. 17 shows a corresponding detail of the apparatus in second embodiment.

FIG. 18 is a cross sectional view of a detail along the line XVIII—XVIII of FIG. 15 and relates to the first embodiment of the apparatus.

A button to be fed comprises an anchoring part, which in its first variant is indicated with 1, and the button proper, hereinafter called the main part and in its first variant indicated with 2. According to FIG. 1 the anchoring part 1 has the shape of a U-shaped square bracket of elastic material, by way of example plastic, and its legs 3 are provided with terminal portions in the shape of pointed hooks 4. The square brackets 1, as is shown in FIG. 2, by means of easily separable connections can be joined to a row similar to the ones, which are used in conventional staplers as seen in FIG. 2.

The main part 2 comprises a plate 5, which in conventional manner cooperates with a buttonhole, which part can be given different designs according to practical and decorative viewpoints. A projection 6 extends from the plate 5, which projection according to FIG. 5 suitably is of longitudinal shape. The projection 6 is perforated by an opening 7, from which holes 8 diverge from each other and extend to the surface 9 of the projection of the plate 5.

In the variant of the embodiment according to the FIGS. 1–3 the anchoring part 1 has two legs 3, and the main part 2 is also provided with two holes 8, the distance in between them at the surface 9 corresponding to the distance between the hooks 4 of the legs 3.

According to FIG. 4 the anchoring part in a variant 10 can be designed with four legs 11, all of them provided with hooks, by means of which the anchoring part has the shape of a cross. The main part 2 according to FIG. 5 is in that embodiment provided with four holes 8 having positions corresponding to the positions of the terminals of the legs 11 of the anchoring part 10.

According to FIG. 6 the anchoring part in a variant 12 can be provided with a plate 13 of centric location, which plate as is shown in FIG. 6 can be of cross-shape, but it can also have another shape, by way of example a round shape. In FIG. 6 the anchoring part 12 has been shown with two legs, but it can likewise be provided with four legs or more. This is shown in FIG. 7 according to which figure an anchoring part in a variant 14 is provided with four legs 15, which depart from two intermediate pieces 16 parallel to each other and are connected by means of a plate 17 similar to the plate 13.

In connection with the embodiment of the anchoring part according to FIGS. 4, 6, 7 the anchoring parts cannot be joined to a row in such a manner as is shown in FIG. 2. In order to facilitate the handling of the anchoring parts and make them suitable for use in a fastening apparatus, it can, however, be suitable to connect them in some other way, by means of, for example, the one illustrated in FIG. 6 in longitudinal arrangement by means of easily detachable connections.

In the embodiment according to FIG. 8 the anchoring part, here indicated with 19, is provided with extended legs 20, which are flexible due to their being of a soft material and provided with weakened portions. The legs are provided with hooks 4. Holes 21 made in the main part, here indicated with 22, are designed with a conical shape, which makes them easy to manufacture. A portion 23 between the holes 21 is extended in order to form a support for the terminals of the hooks of the extended legs 20.

When fastening the button to by way of example a cloth or any other soft flexible material, the anchoring part 1 is threaded through the material with its pointed hooks 4 and introduced into the holes 8 of the main part 2, which then is in position on the other side of the material. When the hooks 4 have penetrated the holes 8 and been inserted in the opening 7, the hooks will get stuck over the edge of the holes 8, and the anchoring part 1 is in an efficient manner held to the main part 2. With the holes 8 and the outer edges of the holes 21 respectively converging as viewed in the direction of introduction, the legs 3, 20 of the anchoring part 1, 19 must be deformed, which increases the springing force in them and gives additional security to the hooking attachment of the hooks round the edges of the holes. The two parts 1 and 2 and 19, 20 respectively are shown joined together in FIGS. 3 and 8 respectively with a material 18 placed between them, whereby the button is held to the material.

The variants 10, 12, and 14 of the anchoring part with the main parts belonging thereto and designed in a corresponding manner function in a manner, which is entirely analogous to the one described. In case several legs are provided on the anchoring part a corresponding increase of the number of perforation points through the material is obtained and thereby a smaller point strain. With such an arrangement the button can be adapted to materials of different hardness and strength. The number of legs is of course not limited to four, but a very great number of them can be provided.

If the anchoring part is provided with a plate according to FIG. 6 or 7 the strength of the connection is still further increased, when material is used, which cannot be subjected to any strain of magnitude. The plate in fact forms a surface of abutment for the anchoring part, which can be designed with any desired size. There is also a possibility to design the plate with a curvature in the direction of the legs, which is shown in FIG. 6, whereby a certain resilience is obtained in the connection. With a plate with arms as in FIG. 6 a great resilience is obtained, while the resilience will be smaller in connection with a round plate even if this has a downwardly directed edge.

In the embodiment illustrated in FIG. 7 and having parallel anchoring parts the corresponding holes on each side in the main part for example in connection with injection moulding of plastics can be shaped with a single mould with a number of cores in parallel arrangement.

The needle-like projections of the anchoring part thus penetrate the textile material at several points without it being necessary to make any holes beforehand. By the fact that the needle-like projections are so thin and by the details having a certain distance relative to each other, they also possess a certain movability in between them, which makes the button flexible and adhering in the same manner as a button fastened by sewing. This movability is especially noticeable in the embodiment according to FIG. 8 because of the extended flexible legs 20 of the anchoring part 19. The fastening procedure can very easily be automated, so that the button details can be held in fixtures and a required number of buttons be fastened in one and the same working moment in an article of dress.

According to the FIGS. 9–14 a complete button comprises a main part 31 and an anchoring part 32 or 33. The main part 31 comprises a plate 34, which is intended in conventional manner to cooperate with a buttonhole when performing the buttoning operation, and in addition also cooperate with a projection 35. The projection 35 is of elongated shape and has a hole 36, from which slits 37 extend. The hole 36 and the slits 37 debouch in an opening 38, which is made through the projection 35.

The anchoring parts 32 and 33 have a shank 39, which terminates in an arrow-like point 40 of round section. The other end of the shank 39 of the anchoring part 32 terminates in a cross-shaped head 41. The arms of the head 41 are bent in a direction towards the point 40. The anchoring part 33 has a corresponding head 42, which on the other hand is of circular shape. It is illustrated in a plan view in FIG. 10, but it can alternatively have the shape of a spherical cap, the periphery of which bends in a direction towards the point 40.

In the usual manner in connection with buttons the plate 35 can be designed for different types of articles of dress and for different decorative desired ends. Instead of having the shape of a button the object, when by way of example it shall be fastened to a cloth, can have the shape of a hook, an eye and so on. The plate 34 then is substituted by a portion, which is shaped like a hook, a loop or some other shape. The projection 35 and the anchoring parts 32, 33, however, may be unchanged.

In order to feed the buttons in a rational manner to processing stations an apparatus 49 according to the invention is equipped with a table 50, on which a number of feeding apparatures 51 are provided, which terminate in a number of fastening or other processing stations 52. The feeding apparatuses 51 are displaceable on the table 50, so that the position of the fastening stations 52 can be adapted to different articles to be processed. Each feeding apparatus 51 comprises an angularly bent rail 53, which is attached to the table 50, and a detachable hopper 54. The hopper 54 has a rail 55 of the same profile as the rail 53. This profile is of C-form with a bottom facing the table 50 and overlapping flanges, which in between them shape a groove 56. The inner distance between the portion of the flanges extending from the bottom is somewhat greater than the width of the plate 34, while the width of the groove 56 is somewhat greater than the width across the projection 35 of the buttons 31, 33.

The rail 53 at its end opposing the station 52 has a sleeve 57, in which the rail 55 of the hopper 54 can be introduced and be anchored by means of a spring holder 58 provided on the hopper. The spring holder 58 has such a springing action that in case the hopper 54 is removed from the rail 53 the free end of the holder will fall inside the orifice of the rail 55 and in order to ensure that it can grapple the sleeve 57 on the outside when pushed on it is provided with a long obliquely extending end portion.

The free end of the hopper 54 is provided with an end cap 59 against the inner surface of which a pressure spring 60 rests, which spring is provided for the displacement of a slide 61 in the rail 55 in a direction towards its orifice.

The two embodiments of the apparatus only differ in respect of the fastening station 52. In the embodiment according to FIG. 16 the rail 53 terminates before the station itself. In the very station, outside the end of the rail 53, there are two sector shaped holders 62, each one of slightly less than 90° extension and according to FIG. 18, each one with a U-shaped profile, with upper and lower parts 63 and mantle parts 64, which together can grip around the edge of the plate 34 of the button. One holder 62 is journalled right in front of the centre of the rail by means of a tubular shaft 65, and the other holder 62 is by means of a shaft 66 journalled inside the tubular shaft 65.

The two shafts 65 and 66 are coupled to a mechanism, not shown, which is arranged to pivot the shafts and thereby pivot the holders 62 between three different positions. In one of these positions the holders are located right in front of each other as is shown in FIG. 15. In the second position the two holders occupy a position against the end of the rail 53 and are thus brought together. In the third position the holders 62 are brought together in a position opposing the second position, thus to the left in FIG. 15.

In the second embodiment according to FIG. 17 the rail 53 extends inside the station 52, however, only with its bottom and the portions of the flanges adjacent to the groove 56, while the lateral portions are cut away as is evident from FIG. 17. Also here two holders 67 are provided in the fastening station, which holders substantially only have mantle portions 68 corresponding to the portions 64 in FIG. 18. The mantle portions 68 by means of short arms are journalled on two shafts corresponding to the shafts 65, 66, and are likewise individually pivotable into three different positions by means of a mechanism, not shown. The first position corresponds to the position illustrated in FIG. 15. In the second position the holders are brought together, in FIG. 17 to the right against the disc 53, and in the third position they are brought together outside of the end of the rail 53, as is shown in FIG. 17. Thus, the three positions correspond to each other in the two embodiments, and in the following the first position (according to FIG. 15) is called the "mid position", the second position (not shown) is called the "inner position" and the third position (according to FIG. 17) the "outer position".

When feeding buttons of the described type for processing by machine, the rails 53, 55 are loaded on the table 50 with buttons as is shown to the left in FIG. 15. The projections 6, 35 thereby protrude out of the groove 56 and the bottons are pressed in a direction towards the fastening station 52 by the slide 61 biased by the spring 60. However, the buttons are prevented from being pressed out of the rail 53 by the holders 62 and 67 respectively occupying the mid position.

When a feeding operation is to be carried out, the holders are pivoted into the outermost position, whereby the slide 61 presses forward the row of buttons until the outermost one is caught by the holders 62 and 67 respectively, which form a terminal stop. Thereafter the holders are pivoted back to the mid position and thereby hold the buttons in exactly the correct position for the fastening or other processing.

After the fastening or processing is completed the holders 62, 67 pivot to the inner position, whereby the outermost button is released and can in unobstructed manner be pulled outwardly, while at the same time the next outermost button is prevented from leaving the rail because the holders occupy a position right in front of the orifice. After the removing of the button the holders 62, 67 are pivoted to the outer most position and a new button is fed from the rail.

When all of the buttons in the hopper 24 have been delivered, the hopper is removed and a new hopper, which has been loaded with a new supply of buttons is inserted. In mounted condition the hopper 54 is held by the spring holder 58.

In the filled but not yet mounted hopper 54 the spring holder 58 lacks support and thereby pivots in above the orifice of the hopper, which prevents that the spring loaded slide 61 can press out the buttons of the rail 55. However, as soon as the hopper has been fitted to the rail 53, the spring holder 58 will be pressed outwardly by the sleeve 27 and leave the buttons free to be pressed further on in the rail 53. In this manner the apparatus rapidly can be loaded without any real interruption of the working cycle.

The hoppers 54 can be loaded in a separate loading apparatus, in which the slide 61 is brought backwards, and the buttons are inserted into the rail in the correct position by means of a vibration device or a feeding apparatus of another type. Such feeding apparatuses are known from, for example, the screw manufacturing industry in order to bring forward screws provided with screw heads in the correct position to a milling station.

I claim:

1. Apparatus for the feeding of buttons or similar objects to a processing station, comprising storing means for storing a number of the objects, said storing means having delivery means and means for pressing the objects toward said delivery means, and two holding elements located at the delivery means arranged to permit feeding of one of the objects from the storing means, catching the object which is fed, holding said fed object in the processing station, and releasing the fed object after the processing thereof, said holding elements each having the form of a section and mounted for rotation into three positions around an axis thereof, a first position being in which both the sections are placed in front of the delivery means at a distance from the delivery means permitting the feeding of one object from the storing means, a second position being in which the sections are placed in front of each other holding the object between the sections, and a third position being in which the sections are placed adjacent to the delivery means releasing the object which is then to be removed from the sections.

2. Apparatus according to claim 1, wherein each section has an extension of not more than 90 degrees from the axis with the sections in the first position pivoted adjacent to each other forming an arc of about 180 degrees opening with its inside toward the delivery means, said sections in the second position being substantially 90 degrees each from the first position so that the object can be retained between the sections, and in the third position said sections being rotated a further 90 degrees and positioned adjacent to each other forming an arc of about 180 degrees opening outwardly from the delivery means and allowing the removal of the object with the outside of said arc facing the delivery means and closing said delivery means.

* * * * *